US005346219A

United States Patent [19]

Pehoski et al.

[11] Patent Number: 5,346,219

[45] Date of Patent: Sep. 13, 1994

[54] GOLF PUTTER HEAD

[76] Inventors: Richard J. Pehoski, 133 Maplewood Dr., Bolingbrook, Ill. 60440; Joseph A. Pessetti, 2910 N. Maple, Franklin Park, Ill. 60131

[21] Appl. No.: 57,875

[22] Filed: May 7, 1993

[51] Int. Cl.[5] ..... A63B 53/04

[52] U.S. Cl. ..... 273/168; 273/78

[58] Field of Search ..... 273/77 R, 167 R, 167 A, 273/167 D, 167 F, 167 H, 167 J, 168, 169, 171, 172, 173, 174, 78, 164.1, 187.4, 186.2

[56] References Cited

U.S. PATENT DOCUMENTS

| | | | |
|---|---|---|---|
| 1,154,490 | 9/1915 | Davis | 273/78 |
| 3,042,405 | 7/1962 | Solheim | 273/168 X |
| 3,578,332 | 5/1971 | Caldwell | 273/167 F X |
| 3,841,640 | 10/1974 | Gaulocher | 273/167 F X |
| 3,851,877 | 12/1974 | Giambazi | 273/167 G X |
| 3,873,094 | 3/1975 | Sebo | 273/167 R X |
| 3,923,308 | 12/1975 | Mills | 273/167 G X |
| 4,523,759 | 6/1985 | Igarashi | 273/169 |
| 4,746,124 | 5/1988 | Comitz | 273/187.4 X |
| 4,756,535 | 7/1988 | Bradley | 273/187.4 |
| 4,979,744 | 12/1990 | Alcala | 273/169 |
| 5,060,950 | 10/1991 | Finney | 273/167 F |

OTHER PUBLICATIONS

"Golf World", Magazine, Dec. 10, 1965 issue, p. 13.

*Primary Examiner*—V. Millin
*Assistant Examiner*—Sebastiano Passaniti
*Attorney, Agent, or Firm*—Leo J. Aubel

[57] ABSTRACT

A symmetrical golf putter head formed of a center elongated bar member and two ball striking plate members affixed in spaced position on opposite sides of the center member as by force fitted plugs, and a plate being flexed when that plate strikes a golf ball to compensate for deflection and provides a more accurate roll in the selected direction. In one embodiment of the invention the putter head is formed from a solid material, and the solid head creates a ringing sound when the ball is struck.

2 Claims, 2 Drawing Sheets

GOLF PUTTER HEAD

BACKGROUND OF INVENTION

Many types of golf putters have been invented and introduced into the game of golf. Various innovative putters, including some with extra long shafts, some with aligning aids, some with extra heavy heads have been introduced into the game. One of such prior art putters which became well known in golf was the Ping putter. The Ping putter had certain innovative features, including a relatively hollow, putter head.

The present invention is and improvement over prior art putters in various aspects, as will be explained hereinbelow.

SUMMARY OF INVENTION

A golf putter comprising a unique head of titanium or brass material formed to have contoured solid forward and rear ends and an intermediate section comprising an elongated rectangular bar member spaced from two rectangular side members.

The golf putter head has a symmetrical configuration comprising first and second members each having ball striking surfaces. Twin spacings separate said first and second members from a center support member to which the golf putter shaft is inserted. The ends of said first and second members are joined.

The foregoing features and advantages of the present invention will be apparent from the following more particular description of the invention. The accompanying drawings, listed hereinbelow, are useful in explaining the invention.

DRAWINGS

Figure 1:
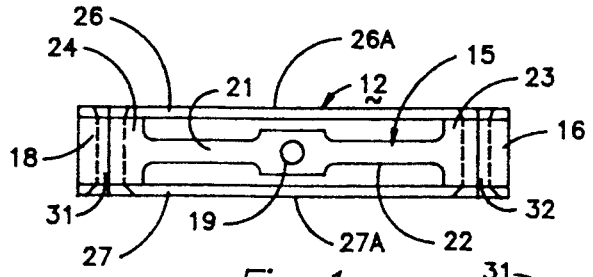
Figure 4:
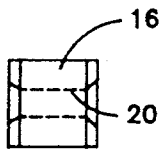
Figure 3:
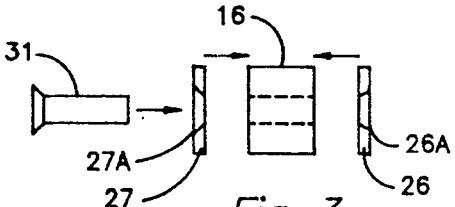
Figure 2:
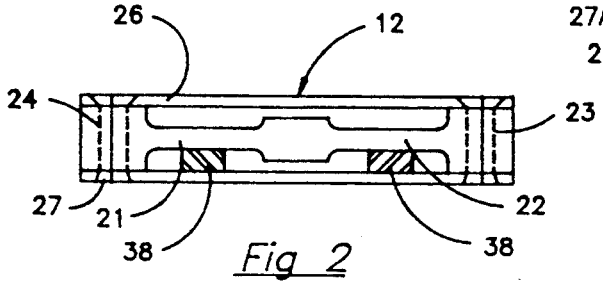
Figure 5:
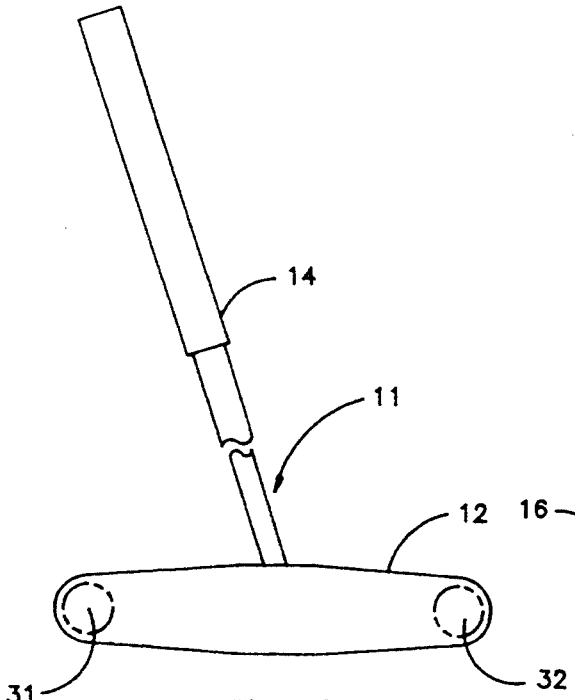
Figure 6:
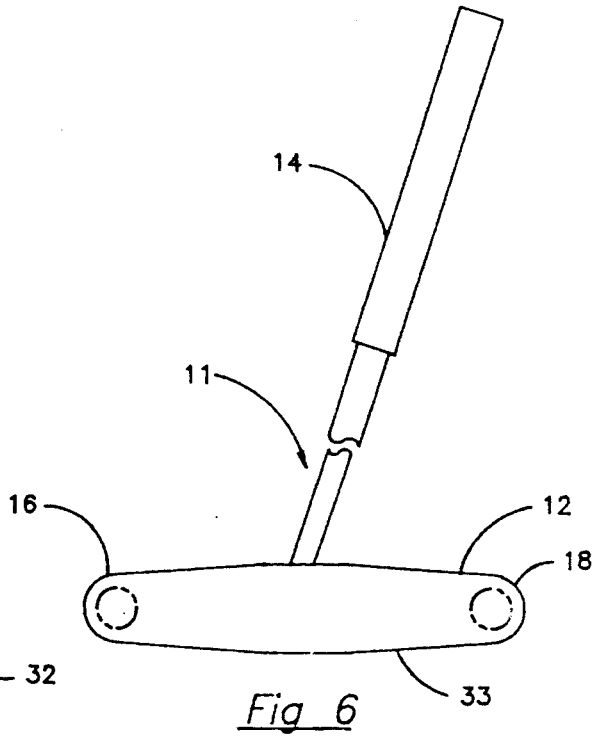
Figure 7:
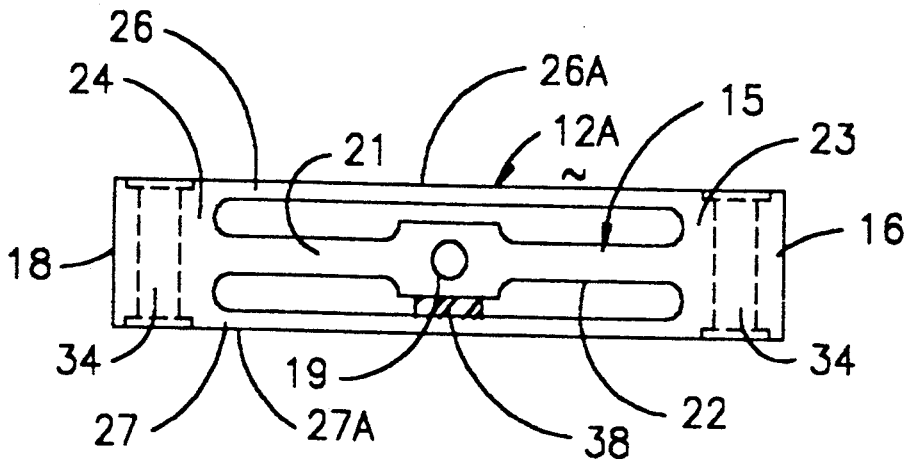
Figure 8:
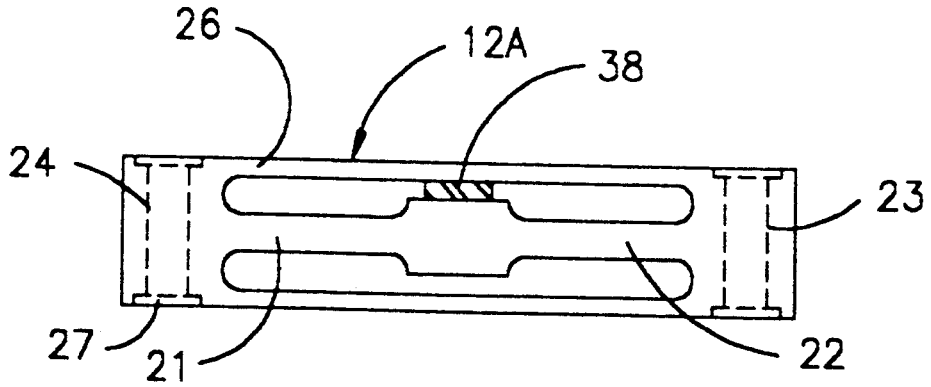

FIG. 1 is a top view of a first embodiment of the inventive golf putter head, FIG. 2 is a bottom view of the golf putter head of FIG. 1, FIG. 3 is an exploded front view of the golf putter head of FIG. 1, FIG. 4 is a front or end view of the golf putter head of FIG. 1, FIG. 5 is a view of one side of the inventive golf putter head of FIG. 1 mounted on a shaft, and FIG. 6 is a side view, opposite the view of FIG. 5, to show the symmetry of the golf putter head, FIG. 7 is a top view of a second embodiment of the inventive putter, and FIG. 8 is a bottom view of the putter head of FIG. 1,

DESCRIPTION OF INVENTION

Refer first to FIGS. 5 and 6 which show a left and right side view of the inventive putter head 12 mounted on a shaft 14 (shown in foreshortened aspect) to form a golf putter 11.

Refer now to FIGS. 1, 2, 3 and 4 which show various views of the inventive golf putter head 12. As mentioned above, FIG. 1 is a top plan view of the putter head 12 showing the elongated rectangular center member or core 15 which is made of brass, titanium or other suitable material, and extends from the toe 16 to the heel 18 of the putter head 12.

The bore 19 for receiving the shaft 14 is formed in the middle of the center member 15. The mid portion of member 15 is symmetrically reduced or relieved in thickness as at 21 and 22. The ends 23 and 24, forming the toe 16 and heel 18, respectively, of the putter head 12 are relatively thicker than the mid portions 21 and 22.

The outer side members 26 and 27, each forming a substantially rectangular plate, are mounted on opposite sides of center member 15, as by suitable press fitted plugs 31 and 32, as indicated in FIGS. 3 and 4. Plugs 31 and 32 are initially slightly longer than the width of the putter head 12 and in assembly each plug is inserted into aligned holes 20 formed in center member 15 and outer side members 26 and 27, then the ends of plugs are compressed to press fit each plug in the respective hole 20, as indicated in FIG. 4. The ends of the plugs 31 and 32 are next ground and polished to be flush with the ball striking surfaces or faces 26A and 27A, respectively, of members 26 and 27. The outer side members 26 and 27 may be made of titanium metal.

The intermediate reduced portions 21 and 22 of the center member 15 provide a spacing between the center member 15 and the outer side members 26 and 27 to permit a flexure of the side members 26 or 27 when that side member strikes the golf ball. The outer side member 26 or 27 striking the ball flexes slightly and compensates for deflection to thereby deliver a more accurate roll. The striking member flexes slightly in opposition to the direction of deflection of the club head when the ball is struck off exact center in either direction, thereby correcting ball direction for producing a more accurate putt. A cradling or guiding action is provided to direct the ball in the direction toward the golf hole.

FIG. 2 is a bottom view of the putter head 12 to clearly show the symmetry of the head 12. As can be seen, the bottom and top of the putter head 12 are similar except for the bore 19 which receives the shaft 14.

As shown in FIGS. 5 and 6, the bottom 33 of head 12 is symmetrically contoured to provide a balanced, contoured and comfortable lie or rest for the putter 11 when it is held in a ball striking position by the golfer. Any suitable shaft 14, either made of metal or of a composite material may be utilized with putter head 12. Note that the putter head 12 has an 18 degree lie angle and zero loft angle to provide a non-skid and true roll of the golf ball when the putter head strikes the ball. The putter head 12 is centrally balanced and the shaft 14 is mounted in the center of the putter head 12 to maintain this precise balance.

Further the high-tech overall side to side and top to bottom symmetrical configuration of the putter head 12 makes for true alignment when attempting to strike or putt the ball toward the hole.

Note that because of the symmetry of the putter head 12, the putter 11 is fully ambidextrous; that is, the putter 11 can be equally useful for both right and left handed golfers.

FIGS. 7 through 10 show a second embodiment of the inventive putter head 12A. The putter head 12A of FIG. 7 is similar in shape and form to putter head 12 of FIG. 1. The difference is that putter head 12A is formed from a solid piece of metal such as brass or titanium. Note that the toe 16 and heel 18 of the putter head 12A include apertures 34 which are provided to decrease the weight of the putter head. Plugs, generally labeled 35 are provided to cap the aperture 34.

The putter head 12A of FIG. 7 provides an additional feature. When the putter head 12A strikes the ball a pleasant ringing sound is produced due to the vibration of the outer side member 26 or 27 striking the ball. The amplitude of the ringing sound may be controlled by inserting one or more pads 38, such as of rubber, between the center member 15 and the side members 26 and 27, as indicated in FIGS. 7 and 8.

While the invention has been particularly shown and described with reference to a preferred embodiment thereof, it will be understood by those skilled in the art, that various changes in form and detail can be made therein without departing from the spirit and scope of the invention.

We claim:

1. A golf putter head, said putter head being of symmetrical configuration and having a bottom and a top, said putter head comprising an elongated rectangular center member, first and second outer side members each having ends, said center member and said side members being of substantially the same height, the ends of said side members being affixed to respective opposite sides of said center member to form relative rigid end portions, said center member having reduced portions on both sides thereof to form two symmetrical spacings each extending from the bottom to the top of said putter head between said reduced portions and said outer side members, said spacings being uniform from the bottom to the top of said putter head, and said spacings enabling said first and second outer members to be less rigid intermediate their ends whereby when either of said outer side members strike a ball there is flexure which geometrically tends to cradle and guide the ball in the line directed.

2. A golf putter head as in claim 1 wherein said putter head is formed of a solid material, and wherein damping pads are receivable in said spacings to control ringing sound produced when said head strikes a ball.

* * * * *